US009377746B2

(12) United States Patent
Kato et al.

(10) Patent No.: US 9,377,746 B2
(45) Date of Patent: Jun. 28, 2016

(54) IMAGE FORMING APPARATUS

(71) Applicants: Shuichi Kato, Nagoya (JP); Seiichi Senda, Anjo (JP); Atsushi Kato, Ichinomiya (JP); Masanari Yoshikawa, Nagoya (JP)

(72) Inventors: Shuichi Kato, Nagoya (JP); Seiichi Senda, Anjo (JP); Atsushi Kato, Ichinomiya (JP); Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/851,332

(22) Filed: Mar. 27, 2013

(65) Prior Publication Data

US 2014/0003837 A1 Jan. 2, 2014

(30) Foreign Application Priority Data

Jun. 27, 2012 (JP) ..... 2012-143711

(51) Int. Cl.
*G03G 21/16* (2006.01)

(52) U.S. Cl.
CPC ..... *G03G 21/1619* (2013.01); *G03G 21/1623* (2013.01); *G03G 2221/1684* (2013.01); *G03G 2221/1869* (2013.01)

(58) Field of Classification Search
CPC ..... G03G 21/1619; G03G 2221/1684; G03G 2221/1869
USPC ..... 399/110, 119
See application file for complete search history.

(56) References Cited

U.S. PATENT DOCUMENTS

| | | | | |
|---|---|---|---|---|
| 5,661,984 | A | 9/1997 | Durrell et al. | |
| 7,447,467 | B2 | 11/2008 | Kamimura et al. | |
| 7,720,413 | B2 | 5/2010 | Kamimura et al. | |
| 8,064,793 | B2 | 11/2011 | Kamimura et al. | |
| 8,200,119 | B2 | 6/2012 | Okabe et al. | |
| 8,265,522 | B2 | 9/2012 | Kamimura et al. | |
| 8,311,437 | B2 | 11/2012 | Sato | |
| 8,457,520 | B2 | 6/2013 | Kamimura et al. | |
| 8,606,142 | B2 | 12/2013 | Kamimura et al. | |
| 8,818,233 | B2 | 8/2014 | Kamimura et al. | |
| 9,141,068 | B2 | 9/2015 | Kamimura et al. | |
| 2003/0016975 | A1 | 1/2003 | Kojima | |
| 2006/0140673 | A1* | 6/2006 | Kamimura et al. | 399/119 |

(Continued)

FOREIGN PATENT DOCUMENTS

| | | | |
|---|---|---|---|
| JP | 2003-080780 | A | 3/2003 |
| JP | 2003-149896 | A | 5/2003 |

(Continued)

OTHER PUBLICATIONS

Feb. 2, 2016—(JP) Notification of Reasons for Refusal—App 2012-143711.

*Primary Examiner* — Erika J Villaluna
(74) *Attorney, Agent, or Firm* — Banner & Witcoff, Ltd.

(57) ABSTRACT

An image forming apparatus comprises: a casing including a side wall having an opening; a drawer member configured to support a plurality of cartridges in such a manner as to allow the cartridges to be detachably attached thereto, and to be movable through the opening from an inside position in which the drawer member is located inside the casing to an outside position in which the drawer member is located outside the casing in a moving direction; and a leg portion configured to support the casing. In this image forming apparatus, the leg portion includes a portion located downstream from the opening in the moving direction of the drawer member.

19 Claims, 8 Drawing Sheets

(56) References Cited

U.S. PATENT DOCUMENTS

| | | | | |
|---|---|---|---|---|
| 2006/0251446 | A1 | 11/2006 | Okabe et al. | |
| 2008/0292355 | A1* | 11/2008 | Sakurai et al. | 399/110 |
| 2009/0028602 | A1 | 1/2009 | Kamimura et al. | |
| 2009/0142092 | A1 | 6/2009 | Sato | |
| 2010/0209140 | A1 | 8/2010 | Kamimura et al. | |
| 2012/0027472 | A1 | 2/2012 | Kamimura et al. | |
| 2012/0263493 | A1 | 10/2012 | Okabe et al. | |
| 2012/0308273 | A1 | 12/2012 | Kamimura et al. | |
| 2013/0004201 | A1 | 1/2013 | Sato | |
| 2013/0259524 | A1 | 10/2013 | Kamimura et al. | |
| 2014/0105644 | A1 | 4/2014 | Kamimura et al. | |
| 2014/0363204 | A1 | 12/2014 | Kamimura et al. | |
| 2015/0378304 | A1 | 12/2015 | Kamimura et al. | |

FOREIGN PATENT DOCUMENTS

| | | | |
|---|---|---|---|
| JP | 2006-184552 | A | 7/2006 |
| JP | 2006-276726 | A | 10/2006 |
| JP | 2008-049659 | A | 3/2008 |
| JP | 2009-139495 | A | 6/2009 |

* cited by examiner

IMAGE FORMING APPARATUS

CROSS-REFERENCE TO RELATED APPLICATION(S)

This application claims priority from Japanese Patent Application No. 2012-143711 filed on Jun. 27, 2012, the disclosure of which is incorporated herein by reference in its entirety.

TECHNICAL FIELD

The present invention relates to an image forming apparatus including a drawer member for holding a plurality of cartridges.

BACKGROUND ART

There is known an image forming apparatus including a drawer member for holding a plurality of cartridges, wherein replacement of a cartridge becomes possible by pulling out the drawer member from the casing.

To be more specific, the image forming apparatus has an opening at the front side of the casing, and the drawer member is configured to be pulled out from the casing through the opening. To replace a cartridge, the user pulls out the drawer member and replaces the cartridge with a new one.

However, according this type of image forming apparatus, if a large downward force is applied to the drawer member during replacement of a cartridge after the drawer member is pulled out from the casing, the casing may disadvantageously topple.

In view of the above, it would be desirable to provide an image forming apparatus which can prevent the casing from toppling, during replacement of a cartridge after the drawer member is pulled out from the casing.

SUMMARY OF THE INVENTION

According to a first aspect of the present invention, an image forming apparatus comprises: a casing including a side wall having an opening; a drawer member configured to support a plurality of cartridges in such a manner as to allow the cartridges to be detachably attached thereto, and to be movable through the opening from an inside position in which the drawer member is located inside the casing to an outside position in which the drawer member is located outside the casing in a moving direction; and a leg portion configured to support the casing. In this image forming apparatus, the leg portion includes a portion located downstream from the opening in the moving direction of the drawer member.

According to a second aspect of the present invention, an image forming apparatus comprises: a casing including a side wall having an opening; a drawer configured to support a plurality of cartridges, and to be movable through the opening from an inside position in which the drawer is located inside the casing to an outside position in which the drawer is located outside the casing in a moving direction; and a sheet cassette configured to store recording media, and having a drawer supporting portion configured to support the drawer located in the outside position. In this image forming apparatus, the drawer supporting portion is located at a position downstream from the opening in the moving direction.

BRIEF DESCRIPTION OF THE DRAWINGS

To better understand the claimed invention, and to show how the same may be carried into effect, reference will now be made, by way of example only, to the accompanying drawings, in which:

FIGS. 4A and 4B are views for explaining operation of a locking member, in which FIG. 4A shows the locking member in a disengaged position, and FIG. 4B shows the locking member in a restriction position;

DESCRIPTION OF EMBODIMENT

Figure 1:
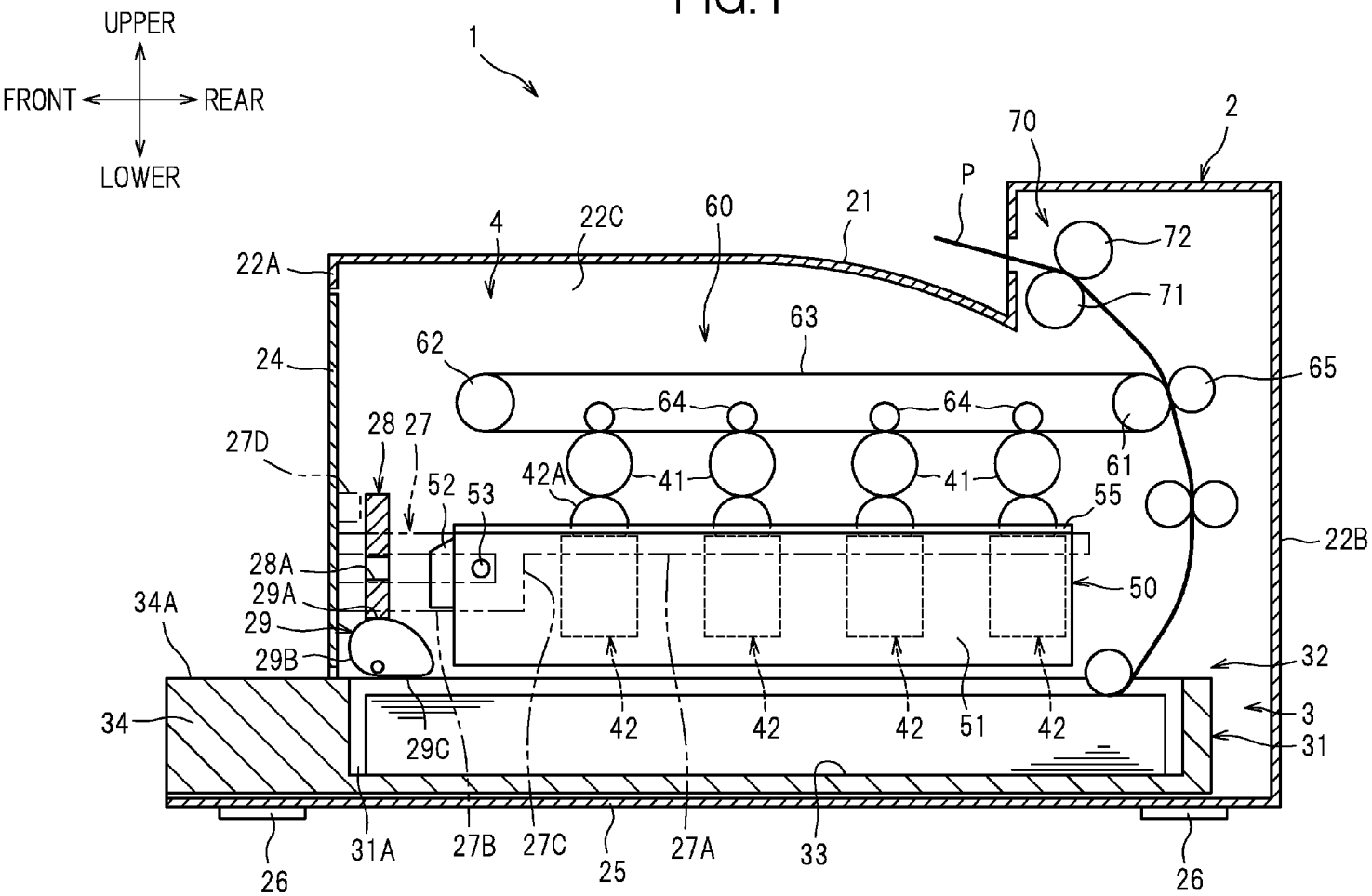
FIG. 1 is a sectional view schematically showing a color printer according to one exemplary embodiment of the present invention.

A detailed description will be given of an illustrative embodiment of the present invention with reference to the accompanying drawings. In the following description, a general structure of a color printer as an example of an image forming apparatus will be described, and thereafter characteristic features of the present invention will be described in detail.

In the following description, the direction is designated as from the viewpoint of a user who is using (operating) the color printer. To be more specific, in FIG. 1, the left-hand side of the drawing sheet corresponds to the "front" side of the color printer, the right-hand side of the drawing sheet corresponds to the "rear" side of the color printer, the front side of the drawing sheet corresponds to the "right" side of the color printer, and the back side of the drawing sheet corresponds to the "left" side of the color printer. Similarly, the direction extending from top to bottom of the drawing sheet corresponds to the "vertical" or "upper-lower" direction of the color printer.

General Structure of Color Printer

As seen in FIG. 1, a color printer 1 mainly includes a casing 2, a sheet feeder unit 3 for feeding a sheet of paper (hereinafter simply referred to as a "sheet" P) as an example of a recording medium, and an image forming unit 4 for forming an image on a sheet P fed from the sheet feeder unit 3.

The casing 2 includes a sheet output tray 21 at an upper portion thereof. The sheet output tray 21 is configured to receive a sheet P ejected outside the casing 2. The casing 2 has a front wall 22A as an example of a side wall, and an opening 23 (see FIG. 2) is formed in the front wall 22A. The opening 23 works as an inlet/outlet through which a holder 50 can be pulled out from the casing 2 (details of the holder 50 will be described later). Further, front covers 24 for opening and closing the opening 23 are swingably supported at the front wall 22A. In this exemplary embodiment, the front covers 24 are configured as a double door (see FIG. 3). Detailed structure of the casing 2 will be described later.

The sheet feeder unit 3 is disposed in a lower portion of the casing 2 and configured to be detachably attached to the casing 2. The sheet feeder unit 3 includes a sheet feed cassette 31 (as an example of a storage portion or a sheet cassette) for storing sheets P, and a sheet feed mechanism 32 configured to feed a sheet P from the sheet feed cassette 31 to a transfer position of the image forming unit 4 (i.e., a nip portion between an intermediate transfer belt 63 and a secondary transfer roller 65). Sheets P stored in the sheet feed cassette 31 are separated one from the other and then conveyed to the transfer position by the sheet feed mechanism 32. Detailed structure of the sheet feed cassette 31 will be described later.

The image forming unit 4 mainly includes four photoconductor drums 41, four chargers (not shown), four development cartridges 42 as an example of a plurality of cartridges, a holder 50 as an example of a drawer member or a drawer, four LED units (not shown), a transfer unit 60, and a fixing device 70.

The photoconductor drums 41 are arranged tandem in the front-rear direction at a position below and opposite to the intermediate transfer belt 63 to be described later.

Each of the development cartridges 42 includes a development roller 42A, a supply roller (not shown), and other parts. The four development cartridges 42 are provided corresponding to the four photoconductor drums 41, and disposed below the corresponding photoconductor drums 41. The four development cartridges 42 are arranged opposite to the intermediate transfer roller 63 to be described later.

The holder 50 is configured to hold the four development cartridges 42 together. The holder 50 is supported by the casing 2 and movable in the front-rear direction. To be more specific, the holder 50 is configured to be movable from an inside position (i.e., installation position shown in FIG. 1) in which the holder 50 is located inside the casing 2 to an outside position (i.e., pulled-out position shown FIG. 2) in which the holder 50 is fully pulled out from the casing 2. In the following description, a direction along which the holder 50 moves from the inside position to the outside position (i.e., direction from the rear side toward the front side of the color printer 1) is simply referred to as a "pull-out direction", which is an example of a moving direction.

Although not shown in the drawings, the four LED units are provided corresponding to the plurality of photoconductor drums 41. Each LED unit is disposed below and opposite to the corresponding photoconductor drum 41. The LED unit is configured to cause a light emission portion to emit light in an on/off fashion in response to image data, so that the surface of the photoconductor drum 41 is exposed to light.

The transfer unit 60 is disposed between the four photoconductor drums 41 and the sheet output tray 21. The transfer unit 60 includes a drive roller 61, a driven roller 62, an intermediate transfer belt 63 in the form of an endless belt looped around the drive roller 61 and the driven roller 62, four primary transfer rollers 64 arranged opposite to the photoconductor drums 41 across the intermediate transfer belt 63, and a secondary transfer roller 65 (as an example of a transfer member) disposed opposite to the intermediate transfer belt 63 at an upstream end of the intermediate transfer belt 63 in the pull-out direction, facing the drive roller 61 across the intermediate transfer belt 63.

The fixing device 70 is disposed above the secondary transfer roller 65. The fixing device 70 mainly includes a heating roller 71, and a pressure roller 72 disposed opposite to the heating roller 71 and configured to be pressed against the heating roller 71.

In the image forming unit 4 configured as described above, the surface of each photoconductor drum 41 is uniformly charged by the charger, and then exposed to light by the LED unit. Accordingly, the absolute value of the electric potential lowers in the exposed area, so that an electrostatic latent image associated with the image data is formed on the surface of each photoconductor drum 41. Toner in the development cartridge 42 is supplied to the development roller 42A via the supply roller.

The toner carried on the development roller 42A is supplied from the development roller 42A to the electrostatic latent image formed on the photoconductor drum 41. Accordingly, the electrostatic latent image is visualized and a toner image is formed on the surface of the photoconductor drum 41. Toner images formed on the respective photoconductor drums 41 are sequentially transferred onto the intermediate transfer belt 63 by the primary transfer rollers 64 to which a set of transfer biases is applied, and superposed one on top of the other to form a complete toner image.

Thereafter, the complete toner image transferred onto the intermediate transfer belt 63 is transferred onto a sheet P by the secondary transfer roller 65 to which a transfer bias is applied, while the sheet P having been supplied to the image forming unit 4 passes through between the intermediate transfer belt 63 and the secondary transfer roller 65. The sheet P with the complete toner image transferred thereon is conveyed to the fixing device 70, and the complete toner image is thermally fixed while the sheet P passes through between the heating roller 71 and the pressure roller 72. The sheet P with the complete toner image thermally fixed thereon is then ejected outside the casing 2 and received by the sheet output tray 21.

Structures of Casing and Sheet Feed Cassette

Structures of the casing 2 and the sheet feed cassette 31 will be described below.

Figure 2:
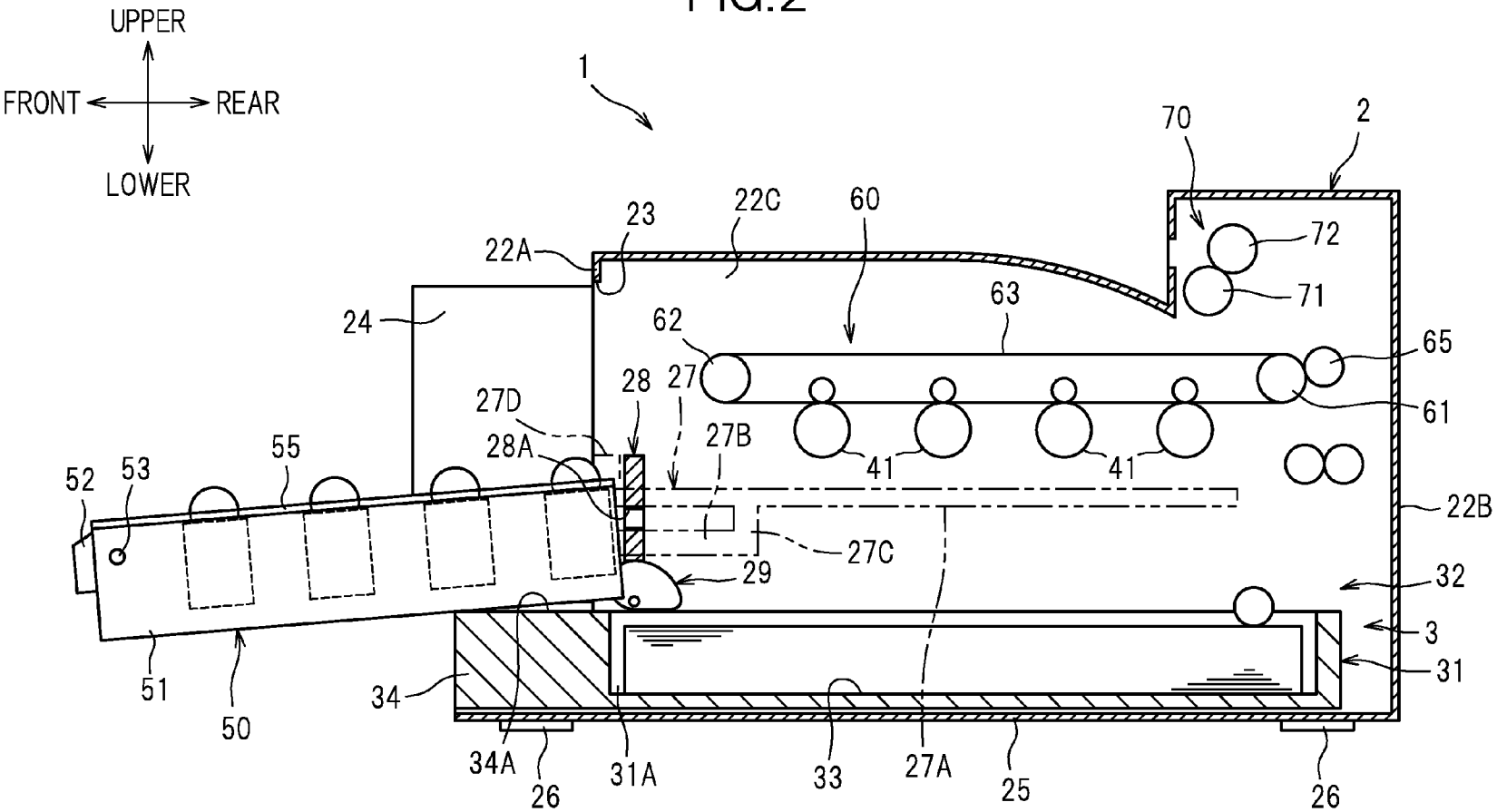
FIG. 2 is a sectional view showing a drawer in an outside position.

As described above, the casing 2 is configured to store the holder 50. As seen in FIG. 2, the casing 2 is configured to allow the holder 50 to be pulled outward from the casing 2 through the opening 23 formed in the front wall 22A.

As seen in FIG. 1, the holder 50 includes a holder body 51 to which the four development cartridges 42 are detachably attached. A handle 52 is provided at the front side of the holder body 51. The user can grip the handle 52 and move the holder 50 in the front-rear direction.

The holder body 51 includes a pair of protrusions 53 extending laterally outward from front end portions of the right and left side walls of the holder body 51, and a pair of flanges 55 provided at the upper end portions of the right and left side walls and protruding laterally outward from the front ends to the rear ends of the side walls.

The flanges 55 are engageable with rail portions 27 provided on the casing 2, which will be described later, so that the holder 50 is movable in the front-rear direction while being supported by the casing.

Figure 3:
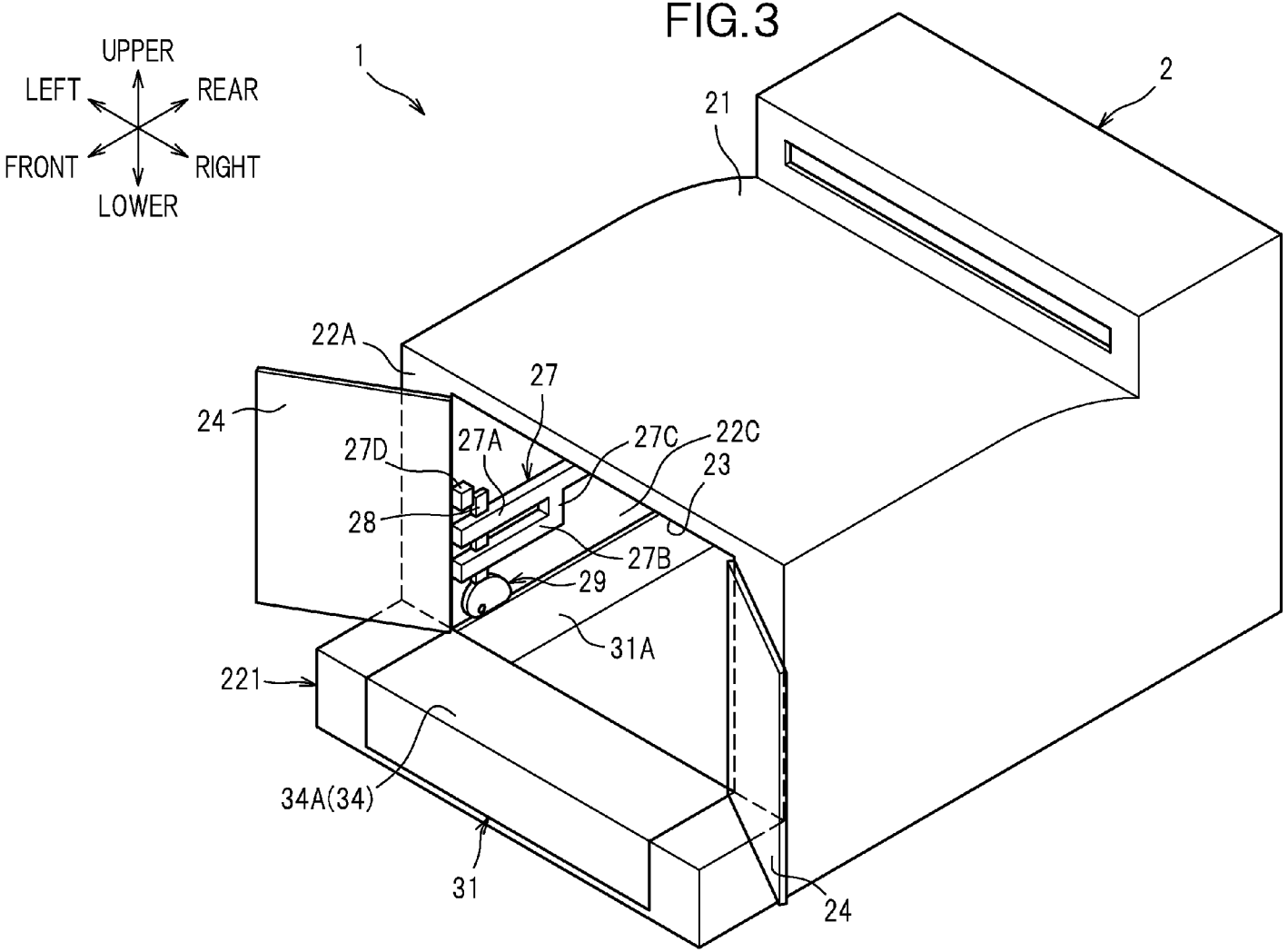
FIG. 3 is a perspective view of the color printer with the front covers being opened and the drawer removed.

As seen in FIGS. 1 and 3, the front side of the casing 2 has an L-shaped cross section. To be more specific, the casing 2 has a cassette storage portion 221 at the front wall 22A, at a position lower than the front covers 24; the cassette storage portion 221 protrudes frontward beyond the opening 23. The cassette storage portion 221 is generally U-shaped configuration as viewed from front; namely, a laterally center portion of the upper surface of the cassette storage portion 221 is recessed downward. When the sheet feed cassette 31 is in an attached position to be describe later, a holder support portion 34 of the sheet feed cassette 31 is fitted into this downwardly recessed portion with the upper surface thereof exposed.

Because of this shape of the casing 2, a bottom wall 25 which constitutes the bottom of the casing 2 extends along the pull-out direction, from a rear wall 22B of the casing 2 to the front side of the casing 2 beyond the opening 23. To be more specific, the front end portion of the bottom wall 25 extends to an end of the holder support portion 34 of the sheet feed cassette 31.

Legs 26 as an example of a leg portion are provided on the bottom wall 25. The legs 26 are integrally formed with the bottom wall 25 and extend downwardly from the bottom wall 25. When the casing 2 is installed on an installation surface, the legs 26 contact the installation surface to support the casing 2. The legs 26 are provided at the four corners of the bottom wall 25. It is noted that the two front legs 26 are provided at positions downstream from the opening 23 in the pull-out direction.

The casing 2 has right and left side walls 22C. Rail portions 27, engagement portions 27D, locking members 28 as an example of a restricting member, and cams 29 as an example of an interlocking mechanism are provided in pairs on inner surfaces of the side walls 22C at positions facing the holder 50 located in the inside position.

The rail portions 27 are fixed to the side walls 22C of the casing 2 and configured to guide the protrusions 53 of the holder 50 as well as to guide and support the flanges 55 of the holder 50. Each rail portion 27 includes a guide portion 27A, a path forming portion 27B, and a restriction portion 27C.

The guide portions 27A are disposed below the flanges 55 of the holder 50. The guide portions 27 extend along the pull-out direction, from a position near the front wall 22A to the rear end portion of the holder 50 located in the inside position.

The path forming portions 27B are disposed below the guide portions 27A. The path forming portions 27B extend along the guide portions 27A, from a position near the front wall 22A to a position below the protrusions 53 of the holder located in the inside position. The path forming portions 27B together with the guide portions 27A form a path for the protrusions 53, along which the protrusions 53 are guided when the holder 50 moves between the inside position and the outside position.

The restriction portions 27C extend upward from rear end portions 27B of the path forming portions (i.e., downstream end portions in the pull-out direction) to the guide portions 27A and connect the path forming portions 27B and the guide portions 27A. The restriction portions 27C restrict the rearward movement of the protrusions 53 of the holder 50.

The engagement portions 27D are disposed near the opening 23 at positions above one ends of the guide portions 27A, and configured such that the flanges 55 of the holder 50 are held between the engagement portions 27D and the guide portions 27A. The engagement portions 27D are engageable with the rear end portions of the flanges 55 when the holder 50 is fully pulled out from the casing 2 (see FIG. 2), so that the rear end portion of the holder 50 can be supported by the casing 2.

Figure 4A:
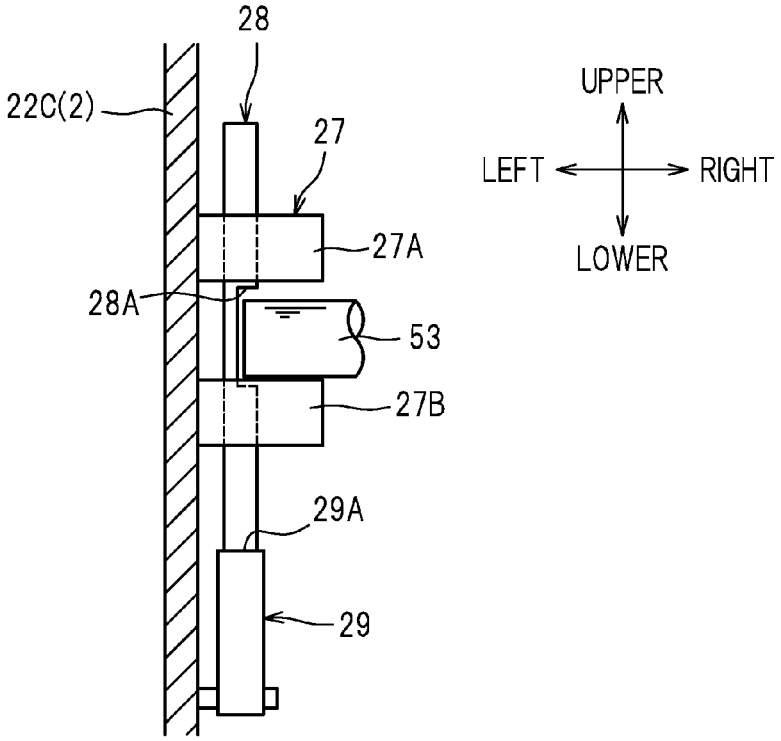
Figure 4B:
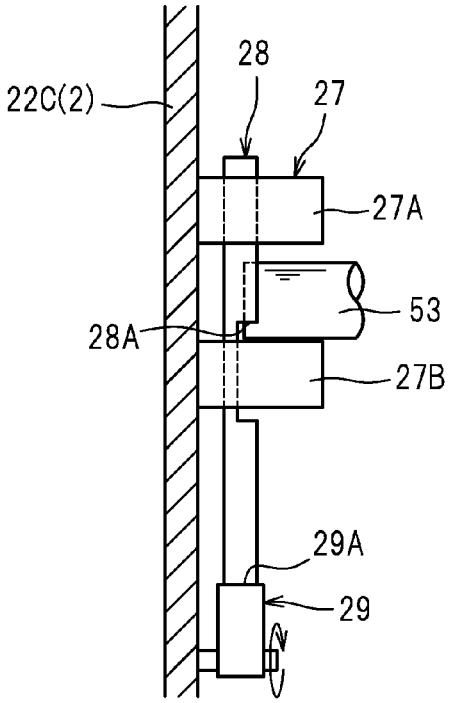

Each locking member 28 is shaped like a rectangular rod and disposed to extend in the upper-lower direction. The locking member 28 is inserted through a through-opening (not shown) formed in the guide portion 27A and a through-opening (not shown) formed in the path forming portion 27B and movable in the upper-lower direction relative to the guide portion 27A and the path forming portion 27B. These through-openings are formed in positions between the opening 23 and the protrusion 53 of the holder 50 located in the inside position. As seen in FIGS. 4A and 4B, the locking member 28 is movable upward or downward relative to the guide portion 27A and the path forming portion 27B, between a restriction position (i.e., position shown in FIG. 4B) in which the movement of the holder 50 from the inside position to the outside position is restricted and a retreated position (i.e., position shown in FIG. 4A) in which the movement of the holder 50 from the inside position to the outside position is allowed. The locking member 28 is positioned in the retreated position when it moves upward from the restriction position, and positioned in the restriction position when it moves downward from the retreated position.

To be more specific, the locking member 28 has a recess portion 28A substantially in the middle of the length thereof. The recess portion 28A is formed such that the surface of the locking member 28 which faces the holder 50 (i.e., laterally inner surface) is recessed outward (in a direction away from the holder 50) in the right-left direction. The recess portion 28A is sized to have a height (distance in the upper-lower direction) greater than the diameter of the protrusion 53 of the holder 50. Further, the depth of the recess portion 28A is sized such that the bottom surface of the recess portion 28A is located laterally outside the distal end of the protrusion 53.

As seen in FIG. 4B, when the locking member 28 is in the restriction position, the recess portion 28A is located in a downwardly shifted position out of alignment with the space between the guide portion 27A and the path forming portion 27B. Accordingly, the locking member 28 overlaps the protrusion 53 as viewed from the pull-out direction, so that the locking member 28 blocks the path for the protrusion 53. On the contrary, as seen in FIG. 4A, when the locking member 28 is in the retreated position, the recess portion 28A is positioned between the guide portion 27A and the path forming portion 27B. Accordingly, the locking member 28 does not overlap the protrusion 53 as viewed from the pull-out direction, so that the path for the protrusion 53 is released.

Each cam 29 is configured to cause the locking member 28 to be positioned in the retreated position when the sheet feed cassette 31 is in the attached position and to cause the locking member 28 to be positioned in the restriction position when the sheet feed cassette 31 has been removed from the casing 2.

As seen in FIG. 1, each cam 29 is rotatably supported on the casing 2 at a position under the locking member 28 and over the right and left side wall 31A of the sheet feed cassette 31. The cam 29 is configured to be oriented to a first attitude (see FIG. 1) when the sheet feed cassette 31 is in the inside position and to a second attitude (see FIG. 5), which is an attitude of the cam 29 turned clockwise in the figures substantially by 90 degrees from the first attitude, when the sheet feed cassette 31 is removed from the casing 2. The cam 29 is weight balanced so as to return to the second attitude by its own weight.

To be more specific, the cam 29 is formed as a disk cam having a generally egg-shaped section, and the contoured edge of the cam 29 provides a first surface 29A, a second surface 29B, and a third surface 29C.

The first surface 29A faces upward when the cam 29 is in the first attitude. In this position, the first surface 29A faces the locking member 28 and supports the locking member 28 in the retreated position.

Figure 5:
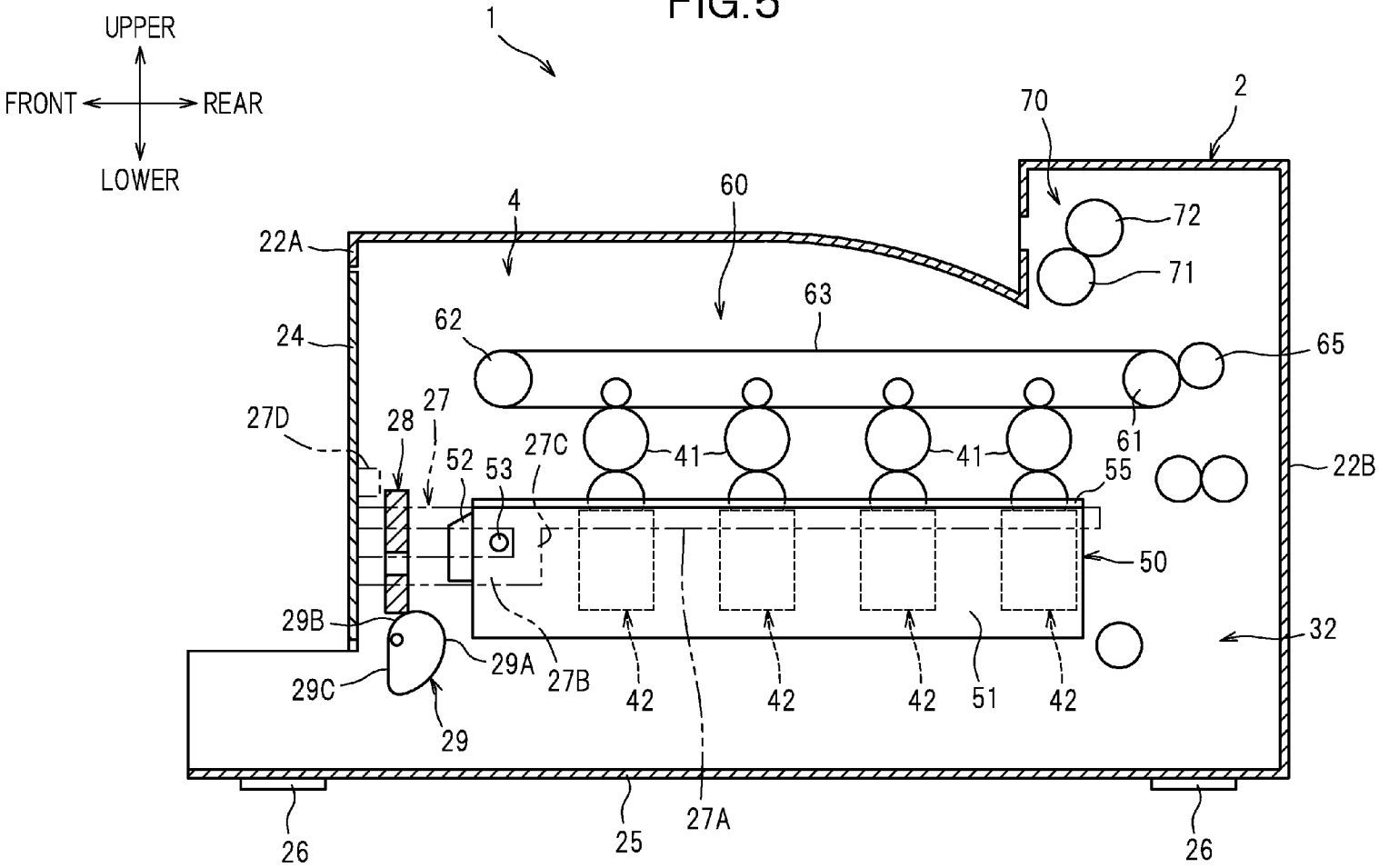
FIG. 5 is a sectional view of the color printer with a sheet feed cassette removed from the casing.

The second surface 29B is disposed closer to a rotation center of the cam 29 than the first surface 29A is; the second surface 29B is provided upstream from the first surface 29A in the direction of rotation of the cam 29 from the first attitude to the second attitude. As seen in FIG. 5, the second surface 29B faces upward when the cam 29 is in the second attitude. In this position, the second surface 29B faces the locking member 28 and supports the locking member 28 in the restriction position.

The third surface 29C is provided upstream from the second surface 29B in the direction of rotation of the cam 29 from the first attitude to the second attitude. The third surface 29C is located at a position lower than the rotation center of the cam 29 and faces frontward when the cam 29 is in the second attitude. In this position, the lower end of the third surface 29C is located below the upper edge of the right and left side wall 31A of the sheet feed cassette 31. Further, the third surface 29C faces away from the first surface 29A with respect to the rotation center. When the cam 29 is in the first attitude, the third surface 29C faces downward and is supported by the sheet feed cassette 31.

With this configuration of the cam 29 as described above, when the sheet feed cassette 31 is inserted into the casing 2 and attached thereto, each of the right and left side walls 31A of the sheet feed cassette 31 contacts the third surface 29C of the cam 29, so that the cam 29 is turned from the second attitude into the first attitude. As seen in FIG. 1, the third surface 29C rides on the sheet feed cassette 31 when the sheet feed cassette 31 is in the attached position, whereby the cam 29 is held in the first attitude. Meanwhile, as seen in FIG. 5, when the sheet feed cassette 31 is pulled outward from the attached position and removed from the casing 2, the cam 29 is oriented from the first attitude to the second attitude by its own weight.

As seen in FIG. 1, the sheet feed cassette 31 is shaped like a rectangular box with the top wall thereof removed. The sheet feed cassette 31 is configured to be movable from the attached position (i.e., position shown in FIG. 1) in which the sheet feed cassette 31 is attached to the casing 2, along the pull-out direction of the holder 50. To load sheets P, the sheet feed cassette 31 can be pulled out from the casing 2. Further, in the attached position of the sheet feed cassette 31, the sheet feed cassette 31 can support the holder 50 located in the outside position.

To be more specific, the sheet feed cassette 31 includes a tray portion 33, and a holder support portion 34 as an example of a drawer member support portion or a drawer supporting portion.

The tray portion 33 is defined as an area, on which a stack of sheets P is placed, and surrounded by the right and left side walls 31A, the front wall, and the rear wall. When the sheet feed cassette 31 is in the attached position, the tray portion 33 is located within the casing 2, more specifically in the rear of the opening 23.

The holder support portion 34 is provided frontward of the tray portion 33 and constitutes a front wall of the tray portion 33. As seen in FIG. 3, when the sheet feed cassette 31 is in the attached position, the holder support portion 34 is fitted in the cassette storage portion 221 of the casing 2, which protrudes frontward beyond the opening 23.

The holder support portion 34 has a support surface 34A; when the sheet feed cassette 31 is in the attached position, the support surface 34A is positioned to extend from the lower side of the opening 23 in the pull-out direction and to face the under surface of the holder 50 located in the outside position (see FIG. 2). The support surface 34A has a width in the right-left direction greater than that of the holder 50. Accordingly, the holder support portion 34 fitted in the cassette storage portion 221 can support the holder 50 located in the outside position.

Operation and advantageous effects of the color printer 1 according to this embodiment will be described below.

To replace a development cartridge 42, the user opens the front covers 24, and then pulls out the holder 50 frontward into the outside position such as shown in FIG. 2. Thereafter, the user removes the old development cartridge 42 from the holder 50 and sets a new development cartridge 42 in the holder 50.

In this position, the holder 50 is not removed from the casing 2 and the rear ends of the flanges 55 are engaged with the engagement portions 27D. If a downward force is applied to the holder 50 while the rear end portion of the holder 50 is supported by the casing 2 at a position adjacent to the opening 23, the force is transmitted from the flanges 55 to the engagement portions 27D, with the result that the casing 2 is apt to topple frontward. In this embodiment, however, since the legs 26 for supporting the casing 2 are provided in positions downstream from the opening 23 in the pull-out direction, the legs 26 can prevent the casing 2 from toppling frontward.

In particular, the configuration of the color printer 1 according to this embodiment is such that the fixing device 70 is disposed above the secondary transfer roller 65. This type of color printer 1 is more liable to topple than the color printer in which the belt and the fixing device are arranged along the pull-out direction, because the size of the casing 2 is smaller in the pull-out direction. However, even in this configuration of the color printer 1, toppling of the casing 2 can be prevented.

While the holder 50 has been pulled out and located in the pulled-position, if a downward force is applied to the holder 50 during replacement of a development cartridge 42, the under surface of the holder 50 contacts the support surface 34A of the holder support portion 34 so that the holder support portion 34 supports the holder 50 at a position downstream from the opening 23 in the pull-out direction. Namely, a supporting portion for supporting the holder 50 which acts as a support point upon replacement of the development cartridge 42 (i.e., contacting portion between the holder 50 and the support surface 34A) is approximated to a force-acting point in which a force is applied to the holder 50. This can reduce a moment applied to the casing 2, so that toppling of the casing 2 can be prevented.

Further, in the case in which the sheet feed cassette 31 has been removed from the casing 2 and the holder 50 is not supported by the holder support portion 34, the cams 29 are turned into the second attitude and the locking members 28 are moved into the restriction position, so that the holder 50 is not allowed to be pulled out from the casing 2 because the movement of the protrusions 53 of the holder 50 is blocked by the locking members 28. This can prevent the holder 50 from being pulled out from the casing 2 under the condition that the holder support portion 34 is unable to support the holder 50.

Further, since the holder support portion 34 is configured as a part of the sheet feed cassette 31, common parts are used and the number of constituent parts can be reduced.

Although an illustrative embodiment of the present invention has been described in detail, the present invention is not limited to this specific embodiment. It is to be understood that various changes and modifications, such as those described below, may be made to any of the specific configurations without departing from the scope of the appended claims. In the following description, parts similar to those previously described in the above embodiment are denoted by the same reference numerals and detailed description thereof will be omitted.

In the above exemplary embodiment, the holder support portion 34 is a part of the sheet feed cassette 31 (storage portion) configured to be movable relative to the casing 2. However, the present invention is not limited to this specific configuration. For example, the holder support portion may be a non-separable portion that is integrally formed with the casing 2 and constitutes the storage portion for storing sheets P.

Figure 6A:
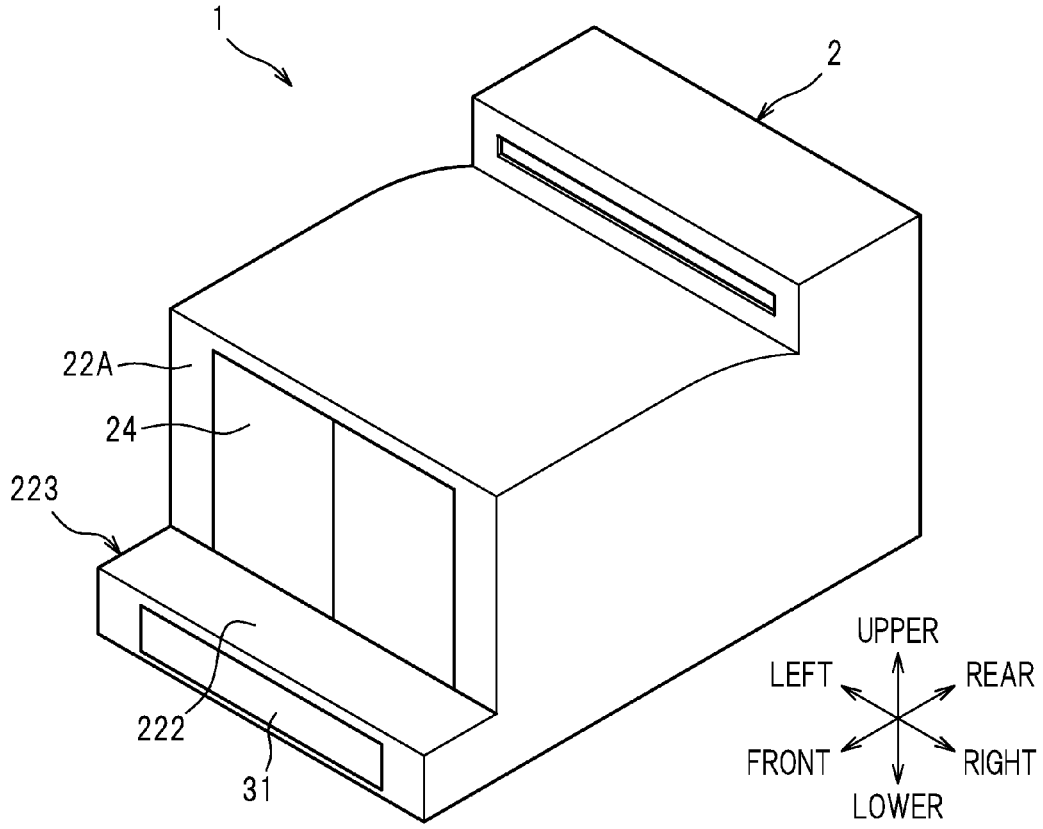
FIG. 6A is a perspective view of a color printer according to a first modification.
Figure 6B:
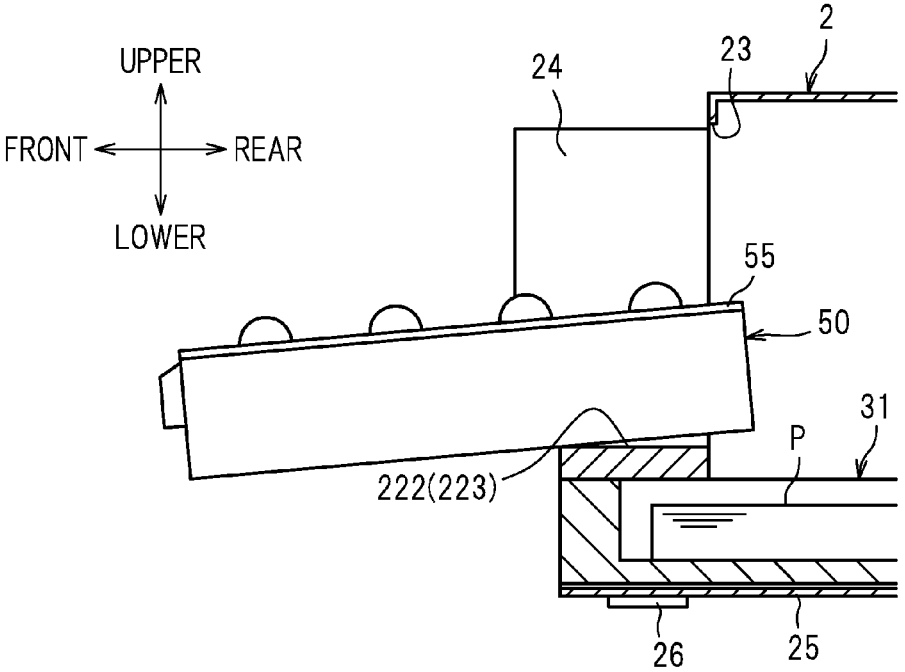
FIG. 6B is sectional view of the color printer of FIG. 6A, showing the drawer in the outside position.

To be more specific, as seen in FIGS. 6A and 6B, a cassette storage portion 223 of the casing 2 has an opening at the front side thereof, and the sheet feed cassette 31 is allowed to be inserted through the opening. In other words, the cassette storage portion 223 is configured to support the front end portion of the sheet feed cassette 31 located in the attached position, more specifically, to surround the upper, lower, right and left portions of the sheet feed cassette 31 that are located frontward of the front wall 22A. The cassette storage portion 223 includes a holder support portion 222 configured to cover the upper part of the front end portion of the sheet feed cassette 31. In this modification, the sheet feed cassette 31 and the cassette storage portion 223 constitute the storage portion for storing sheets P.

According to this modified color printer 1 configured as described above, the holder support portion 222 of the storage portion, which is the non-separable portion integrally formed with the casing 2, can support the holder 50 located in the outside position. Accordingly, even if the holder 50 is pulled out from the casing 2 while the sheet feed cassette 31 has been removed from the casing 2, the holder 50 can be supported by the holder support portion 222 at a position downstream from the opening 23 in the pull-out direction.

In the above exemplary embodiment, the holder support portion 34 is a part of the sheet feed cassette 31 (storage portion) for storing sheets P. However, the present invention is not limited to this specific configuration. For example, the holder support portion may be provided separately from the storage portion.

Figure 7:
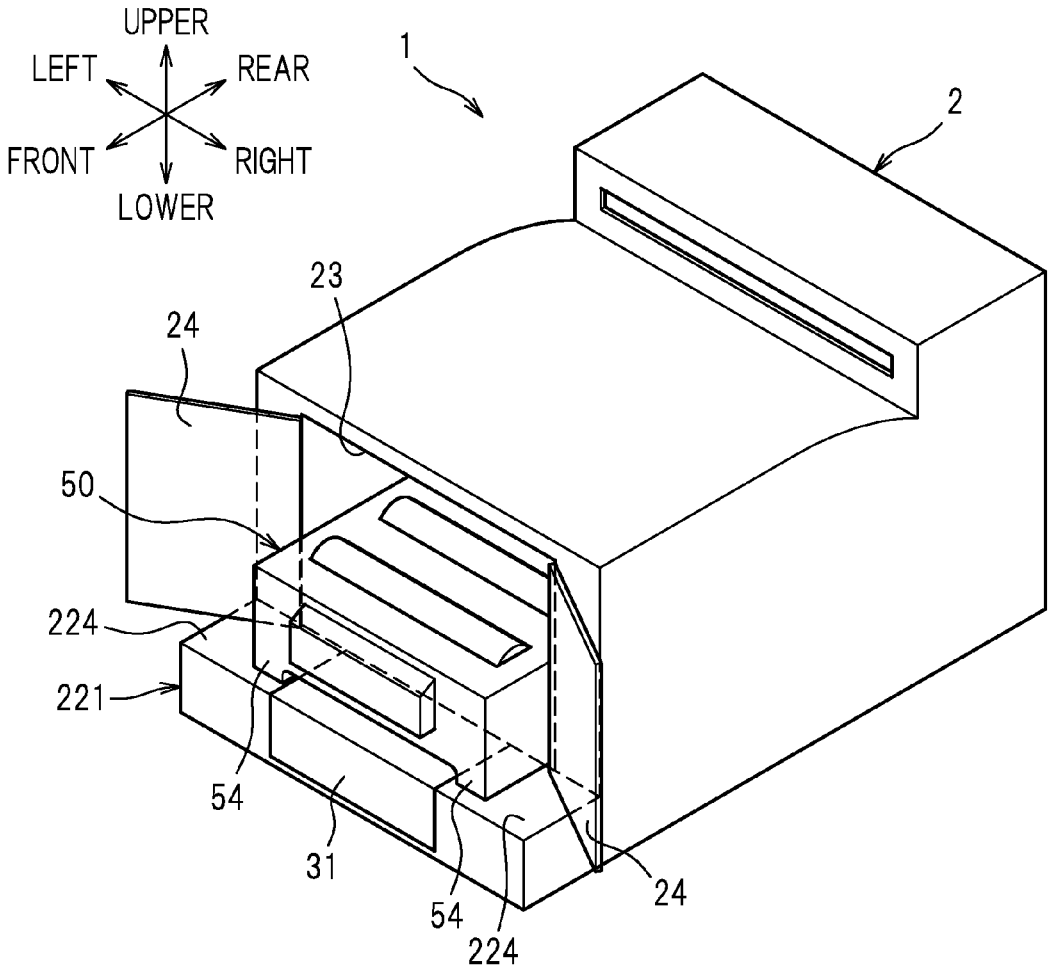
FIG. 7 is a perspective view of a color printer according to a second modification, showing the drawer slightly pulled out from the casing.

To be more specific, as seen in FIG. 7, the holder 50 has a width in the right-left direction greater than that of the sheet feed cassette 31, and downwardly extending legs 54 are provided at both right and left sides of the under surface of the holder 50.

When the sheet feed cassette 31 is in the attached position, it is located between the right and left legs 54 of the holder 50 in the right-left direction. The cassette storage portion 221 has a recessed portion for receiving the sheet feed cassette 31; the recessed portion has a width in the right-left direction corresponding to the width of the sheet feed cassette 31. In this cassette storage portion 221, both side end parts arranged at right and left sides of the sheet feed cassette 31 define a holder support portion 224. Namely, the holder support portion 224 is integrally formed with the casing 2.

According to this modified color printer 1 configured as described above, when the holder 50 is pulled out from the casing 2, the legs 54 contact the holder support portion 224, so that the holder 50 is supported by the holder support portion 224 (casing 2). Accordingly, even if the holder 50 is pulled out from the casing 2 while the sheet feed cassette 31 has been removed from the casing 2, the holder 50 can be supported by the holder support portion 224 at a position downstream from the opening 23 in the pull-out direction.

In the above exemplary embodiment, the development cartridges 42 are employed as a plurality of cartridges held by the holder 50. However, the present invention is not limited to this specific embodiment. For example, the cartridges held by the holder 50 may be a plurality of process cartridges each inclusively containing a photoconductor drum 41 and a development cartridge 42. As an alternative, the cartridges may be a plurality of drum units each inclusively containing parts such as a photoconductor drum 41 and a charger.

In the above exemplary embodiment, two front legs 26 out of the plurality of legs 26 are provided at positions downstream from the opening 23 in the pull-out direction. However, the present invention is not limited to this specific arrangement. For example, only one leg 26 or three or more legs 26 out of the plurality of legs 26 may be provided downstream from the opening 23 in the pull-out direction.

Further, in the above exemplary embodiment, the legs 26 are provided at the four corners of the bottom wall 25 of the casing 2. However, the present invention is not limited to this specific configuration. For example, the legs may be elongated projections extending from the front end to the rear end of the bottom wall 25 or from the left end to the right end of the bottom wall 25. As an alternative configuration, the bottom wall 25 may not have any leg portions, and the bottom wall 25 may directly contact the installation surface. In other words, the bottom wall 25 may constitute a leg portion.

Figure 8:
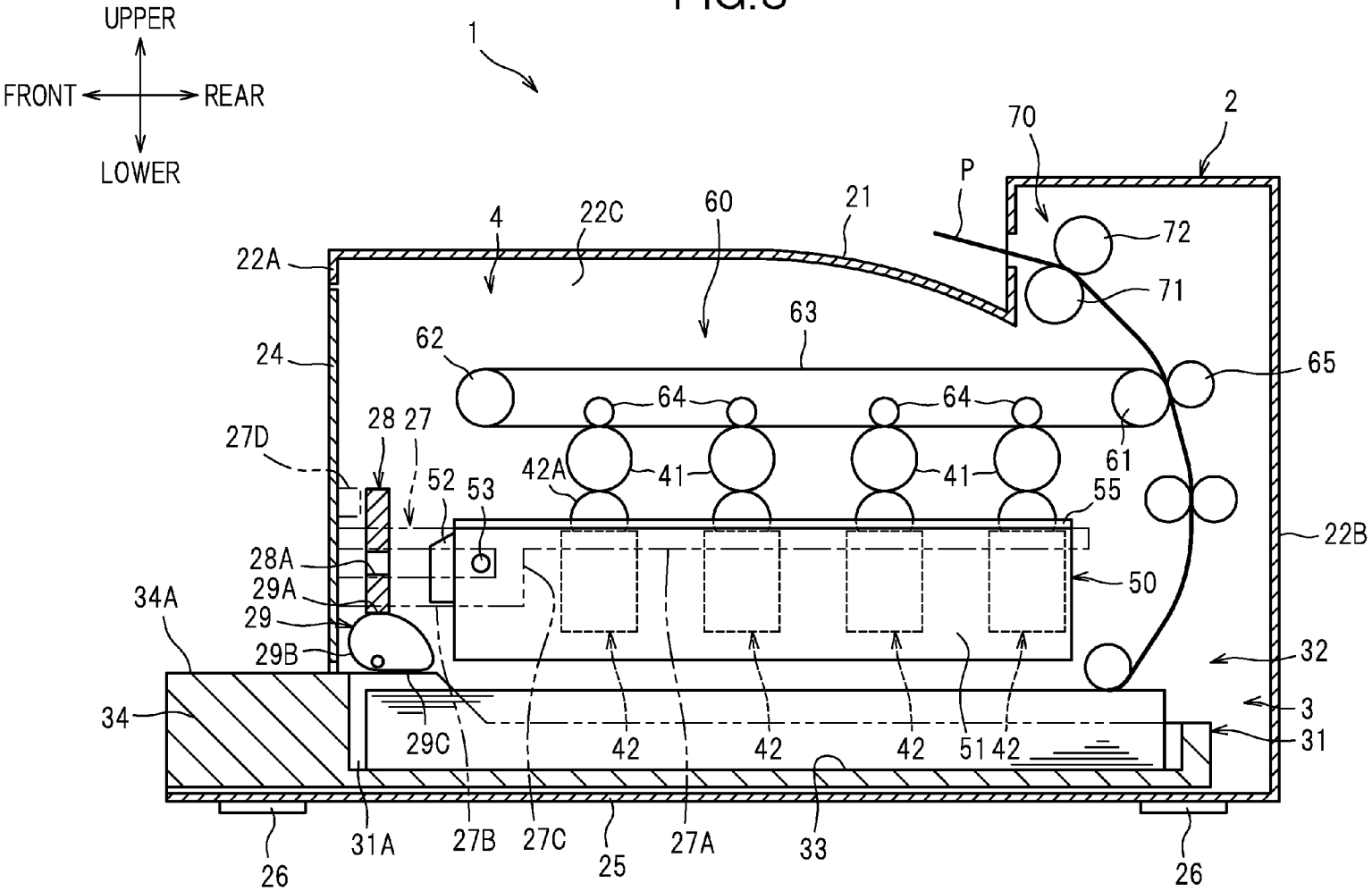
FIG. 8 is a sectional view schematically showing a color printer according to a third modification.

In the above exemplary embodiment, each of the cams 29 (interlocking mechanism) is configured to cause the locking member 28 to be moved from the retreated position to the restriction position when the sheet feed cassette 31 is removed from the casing 2 (more specifically, after the rear end of the sheet feed cassette 31 passes through the cam 29). However, the present invention is not limited to this specific configuration. For example, as seen in FIG. 8, the interlocking mechanism may be configured such that the side walls of the sheet feed cassette 31 may be partly cut out in the front-rear direction, whereby the locking members 28 are caused to be moved from the retreated position to the restriction position when the sheet feed cassette 31 is pulled out from the casing 2 and moved by a small distance (i.e., not the distance corresponding to the whole length of the side walls of the sheet feed cassette 31 as shown in FIG. 1).

Further, in the above exemplary embodiment, the secondary transfer roller 65 is disposed opposite to the intermediate transfer belt 63 at the upstream end of the intermediate transfer belt 63 in the pull-out direction. However, the present invention is not limited to this specific arrangement. For example, the secondary transfer roller 65 may be disposed opposite to the intermediate transfer belt 63 at the downstream end of the intermediate transfer belt 63 in the pull-out direction.

In the above exemplary embodiment, the image forming apparatus according to the present invention is embodied as an intermediate transfer type color printer 1 in which an image is formed on a sheet P by the intermediate transfer belt 63. However, the present invention is not limited to this specific configuration. For example, the image forming apparatus may comprise a plurality of transfer rollers corresponding to a plurality of photoconductors, and may be configured to convey a sheet P between each photoconductor and each transfer roller to transfer an image onto the sheet P.

Further, in the above exemplary embodiment, a sheet P such as a regular paper and a postcard is used as an example of a recording medium. However, an OHP sheet or other media may be used as the recording medium.

What is claimed is:

1. An image forming apparatus comprising:

a casing including a side wall having an opening and a bottom portion;

a cover member configured to close the opening;

a drawer member configured to support a plurality of cartridges in such a manner as to allow the cartridges to be detachably attached thereto, and to be movable through the opening in a moving direction from an inside position in which the drawer member is located inside the casing to an outside position in which the drawer member is located outside the casing;

a drawer member support portion configured to support the drawer member located in the outside position, at a position downstream from the opening in the moving direction of the drawer member; and a contact surface disposed at the bottom portion of the casing and configured to contact an installation surface on which the image forming apparatus is placed;

wherein at least a part of the contact surface is located downstream from a downstream end of the cover member in the moving direction of the drawer member when the cover member is closed, wherein the part of the contact surface located downstream from a downstream end of the cover member in the moving direction of the drawer member when the cover member is closed is stationary relative to the casing, wherein the contact surface is stationary with respect to the installation surface and is in contact with the installation surface when the drawer member is in the inside position and in the outside position, and wherein the drawer member is relatively movable with respect to the casing, the contact surface, and the drawer member support portion when it moves between the inside position and the outside position.

2. The image forming apparatus according to claim 1, further comprising a storage portion configured to store recording media and having the drawer member support portion.

3. The image forming apparatus according to claim 2, wherein the storage portion is configured to be detachably attached to the casing, and wherein the storage portion supports the drawer member when it is in an attached position in which the storage portion is attached to the casing.

4. The image forming apparatus according to claim 3, further comprising:

a restricting member configured to be movable between a restriction position in which movement of the drawer member from the inside position to the outside position is restricted and a retreated position in which the movement of the drawer member from the inside position to the outside position is allowed; and an interlocking mechanism configured to cause the restricting member to be positioned in the retreated position when the storage portion is in the attached position and to cause the restricting member to be positioned in the restriction position when the storage portion is removed from the casing.

5. The image forming apparatus according to claim 1, wherein the drawer member support portion is integrally formed with the casing.

6. The image forming apparatus according to claim 1, further comprising:

a belt disposed above the plurality of cartridges;

a transfer member facing to the belt at an upstream end of the belt in the moving direction of the drawer member; and a fixing device disposed above the transfer member and configured to fix an image formed on a recording medium, wherein the image forming apparatus is configured to form an image on a recording medium while the recording medium passes through between the belt and the transfer member.

7. The image forming apparatus according to claim 1, wherein the casing includes a protruding portion extending downstream in the moving direction of the drawer member beyond the side wall, and the at least a part of the contact surface is provided on a bottom surface of the protruding portion.

8. The image forming apparatus according to claim 7, wherein the drawer member support portion is formed on an upper surface of the protruding portion.

9. The image forming apparatus according to claim 7, further comprising a plurality of legs provided on the bottom portion of the casing, wherein at least a part of the legs is provided on the protruding portion.

10. The image forming apparatus according to claim 7, wherein the bottom portion of the casing forms the contact surface, and the at least a part of the contact surface is provided on the protruding portion.

11. An image forming apparatus comprising:

a casing including a side wall having an opening and a bottom portion;

a cover member configured to close the opening;

a drawer configured to support a plurality of cartridges, and to be movable through the opening in a moving direction from an inside position in which the drawer is located inside the casing to an outside position in which the drawer is located outside the casing;

a sheet cassette configured to store recording media, and having a drawer supporting portion configured to support the drawer located in the outside position, the drawer supporting portion being located at a position downstream from the opening in the moving direction of the drawer;

a contact surface disposed at the bottom portion of the casing and configured to contact an installation surface on which the image forming apparatus is placed; and a plurality of legs provided on the bottom portion of the casing, wherein at least a part of the contact surface is located downstream from a downstream end of the cover member in the moving direction of the drawer when the cover member is closed, wherein the casing includes a protruding portion extending downstream in the moving direction of the drawer beyond the downstream end of the cover member when the cover member is closed, and the at least a part of the contact surface is provided on a bottom surface of the protruding portion, wherein at least a part of the legs is provided on the protruding portion, and wherein the part of the legs provided on the protruding portion is stationary relative to the casing.

12. The image forming apparatus according to claim 11, wherein the sheet cassette is configured to be detachably attached to the casing, and wherein the sheet cassette supports the drawer when it is in an attached position in which the sheet cassette is attached to the casing.

13. The image forming apparatus according to claim 12, further comprising:

a restricting member configured to be movable between a restriction position in which movement of the drawer from the inside position to the outside position is restricted and a retreated position in which the movement of the drawer from the inside position to the outside position is allowed; and an interlocking mechanism configured to cause the restricting member to be positioned in the retreated position when the sheet cassette is in the attached position and to cause the restricting member to be positioned in the restriction position when the sheet cassette is removed from the casing.

14. The image forming apparatus according to claim 11, wherein the drawer supporting portion is integrally formed with the casing.

15. The image forming apparatus according to claim 11, further comprising:

a belt disposed above the drawer;

a transfer roller configured to form an image on a recording medium when the recording medium passes through between the belt and the transfer roller; and a fixing device disposed above the transfer roller and configured to fix the image formed on the recording medium.

16. An image forming apparatus comprising:

a casing including a side wall having an opening;

a drawer configured to support a plurality of cartridges, and to be movable through the opening in a moving direction from an inside position in which the drawer is located inside the casing to an outside position in which the drawer is located outside the casing;

a sheet cassette configured to store recording media, and having a drawer supporting portion configured to support the drawer located in the outside position, the drawer supporting portion being located at a position downstream from the opening in the moving direction;

a restricting member configured to be movable between a restriction position in which the movement of the drawer from the inside position to the outside position is restricted and a retreated position in which the movement of the drawer from the inside position to the outside position is allowed; and an interlocking mechanism configured to cause the restricting member to be positioned in the retreated position when the sheet cassette is in an attached position and to cause the restricting member to be positioned in the restriction position when the sheet cassette is removed from the casing;

wherein the sheet cassette is configured to be detachably attached to the casing, and wherein the sheet cassette supports the drawer when it is in an attached position in which the sheet cassette is attached to the casing.

17. The image forming apparatus according to claim 16, wherein the drawer supporting portion is integrally formed with the casing.

18. The image forming apparatus according to claim 16, further comprising:

a belt disposed above the drawer;

a transfer roller configured to form an image on a recording medium when the recording medium passes through between the belt and the transfer roller; and a fixing device disposed above the transfer roller and configured to fix the image formed on the recording medium.

19. The image forming apparatus according to claim 16, further comprising:

a belt disposed above the plurality of cartridges;

a transfer member facing to the belt at an upstream end of the belt in the moving direction of the drawer; and a fixing device disposed above the transfer member and configured to fix an image formed on a recording medium;

wherein the image forming apparatus is configured to form an image on a recording medium while the recording medium passes through between the belt and the transfer member.

* * * * *